US007796148B2

(12) United States Patent
Kweon et al.

(10) Patent No.: US 7,796,148 B2
(45) Date of Patent: Sep. 14, 2010

(54) TONER SUPPLY ROLLER AND IMAGE FORMING APPARATUS USING THE SAME

(75) Inventors: Soon-Cheol Kweon, Seoul (KR); Kyu-Ho Shin, Seoul (KR); Ki-Hwan Kwon, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/436,318

(22) Filed: May 6, 2009

(65) Prior Publication Data

US 2010/0033546 A1 Feb. 11, 2010

(30) Foreign Application Priority Data

Aug. 6, 2008 (KR) ..... 10-2008-0077023

(51) Int. Cl.
*B41J 2/39* (2006.01)

(52) U.S. Cl. ..... 347/140

(58) Field of Classification Search ..... 347/140, 347/224

See application file for complete search history.

(56) References Cited

U.S. PATENT DOCUMENTS

| | | | | |
|---|---|---|---|---|
| 4,464,672 | A * | 8/1984 | Lindahl | 347/151 |
| 4,635,074 | A * | 1/1987 | Young | 346/74.2 |
| 6,014,157 | A * | 1/2000 | Slot et al. | 347/141 |
| 7,489,327 | B2 * | 2/2009 | Kweon et al. | 347/151 |

FOREIGN PATENT DOCUMENTS

| | | |
|---|---|---|
| JP | 59-224369 | * 12/1984 |
| JP | 08062971 | * 3/1996 |
| JP | 08-114979 | * 5/1996 |
| JP | 09068863 | * 3/1997 |

* cited by examiner

*Primary Examiner*—Huan H Tran
(74) *Attorney, Agent, or Firm*—Staas & Halsey LLP

(57) ABSTRACT

Provided are a toner supply roller and an image forming apparatus using the toner supply roller. The image forming apparatus employs a direct image developing technique, and includes the toner supply roller having a plurality of electrodes formed on an outer surface thereof to selectively supply toner to an image forming unit.

26 Claims, 3 Drawing Sheets

TONER SUPPLY ROLLER AND IMAGE FORMING APPARATUS USING THE SAME

CROSS-REFERENCE TO RELATED PATENT APPLICATION

This application claims the benefit of Korean Patent Application No. 10-2008-0077023, filed on Aug. 6, 2008, in the Korean Intellectual Property Office, the disclosure of which is incorporated herein in its entirety by reference.

TECHNICAL FIELD

The present disclosure relates to an image forming apparatus that develops a direct toner image.

BACKGROUND OF RELATED ART

Electro-photographic image forming apparatuses form an electrostatic latent image on a drum surface, develop the electrostatic latent image by using a developing agent such as toner so as to generate a developed image, and transfer and fuse the developed image onto a printing medium, thereby printing an image.

Typical electro-photographic image forming apparatuses apply a high voltage to a photosensitive drum surface so as to charge the drum surface, and perform a light exposing operation on the charged drum surface according to the data representative of the desired image, thereby forming an electrostatic latent image on the drum surface. Thus, in order to form an electrostatic latent image on the drum surface, typical electro-photographic image forming apparatuses include a photosensitive drum, a charging device, and an optical scanning device. However, unfortunately, the time required to perform the charging and/or exposing operations on the photosensitive drum places a limit on the reduction of the printing speed, i.e., the time required for forming an image. Moreover, the necessity of providing the charging device and the optical scanning device also limit the efforts to reduce the size of a typical electro-photographic image forming apparatuses. Thus, it is difficult to meet the market demands for faster and compact products.

Accordingly, there has been suggested a direct image developing technique, in which toner is selectively transferred to, so as to directly form an image on, a drum without requiring the use of the charging device and/or the optical scanning device. Direct image developing type image forming apparatuses transfer toner to a plurality of ring electrodes of an image forming unit by the use an electrostatic attraction, and selectively collect the toner from the image forming unit by applying magnetic force, thereby forming an image. However, such direct image developing type image forming apparatuses require magnetic field lines having exact boundaries and exact distribution in order to form a high-quality image, and require a magnetic force creating unit to remove the toner as well as a toner transfer unit to supply toner to the image forming unit, and thus require a complex structure.

SUMMARY OF DISCLOSURE

According to an aspect of the described embodiments, there is provided a toner supply roller that may comprise a sleeve comprising a sleeve body of a cylindrical shape and a plurality of first electrodes arranged on an outer surface of the sleeve body; and a magnetic force creating unit disposed inside the sleeve body.

Each of the plurality of first electrodes may be a stripe electrode having a stripe shape that extends in an axial direction of the sleeve body.

The plurality of first electrodes may be common electrodes that share a common electrical connection.

The sleeve body may be formed of a non-magnetic electrically conductive metal forming the common electrical connection of the plurality of first electrodes.

The plurality of first electrodes may be equi-angularly positioned along the outer surface of the sleeve body.

The plurality of first electrodes may be formed of a material which is both magnetic and electrically conductive.

An insulator may be interposed between the plurality of first electrodes.

The magnetic force creating unit may be stationary. The sleeve may be arranged to rotate around the magnetic force creating unit.

The magnetic force creating unit may be a magnetic roller having a plurality of magnetic poles.

The plurality of magnetic poles of the magnetic force creating unit may be arranged in such a manner that opposite magnetic poles are arranged alternately to face the inner surface of the sleeve.

The sleeve body may be formed of a non-magnetic material.

According to another aspect, there is provided an image forming apparatus that may comprise a toner supply roller which comprises a sleeve comprising a sleeve body of a cylindrical shape and a plurality of first electrodes arranged on an outer surface of the sleeve body, and a magnetic force creating unit disposed inside the sleeve body; and an image forming unit disposed to face the toner supply roller, the image forming unit being rotatably driven, and comprising a plurality of second electrodes.

The plurality of first electrodes and the plurality of second electrodes may cross each other. At least one of the plurality of first electrodes and the plurality of second electrodes may be individually controlled to selectively moved toner from the toner supply roller to the image forming unit.

Each of the plurality of first electrodes may be a stripe electrode having a stripe shape that extends in an axial direction of the sleeve body. Each of the plurality of second electrodes may be a ring-shaped electrode formed around the image forming unit.

The plurality of first electrodes may be common electrodes to which a common electrical power is applied. The plurality of second electrodes may be configured to receive electrical power individually.

The sleeve body may be formed of a non-magnetic electrically conductive metal to provide a common electrical connection to the plurality of first electrodes.

The plurality of first electrodes may be formed of a material which is both magnetic and electrically conductive.

The magnetic force creating unit may be stationary. The sleeve may be arranged to rotate around the magnetic force creating unit.

The magnetic force creating unit may be a magnetic roller having a plurality of magnetic poles.

According to another aspect, a toner image forming device may comprise a toner carrying roller of cylindrical shape and an image carrying roller of cylindrical shape. The toner carrying roller may have disposed on outer circumferential surface thereof first electrodes. The image carrying roller may have disposed on outer circumferential surface thereof second electrodes. The image carrying roller may be arranged substantially parallel to the toner carrying roller such that respective outer surfaces of the toner carrying roller and the image carrying roller opposingly facing each other in a toner transfer region. The intersections of the first electrodes and second electrodes at the toner transfer region may define a plurality of individually selectable toner transfer paths from the toner carrying roller to the image carrying roller.

The first electrodes may comprise a finite number of stripe electrodes arranged at a regular interval. Each stripe electrode may extend parallel to lengthwise axis of the toner carrying roller. The second electrodes may comprise a finite number of ring electrodes arranged at a regular interval. Each of the ring electrode may form a ring around the outer circumferential surface of the image carrying roller such that the ring electrodes intersect with at least one stripe electrode at the toner transfer region. Each individual one of the ring electrodes may be selectable for applying electrical energy thereto to cause toner particles to be transferred from the toner carrying roller to the image carrying roller at the toner transfer region.

Each of the stripe electrodes may be connected to a common electrical potential.

The toner carrying roller may comprise a cylindrical sleeve and a magnetic member. The outer surface of the cylindrical sleeve may define the outer circumferential surface of the toner carrying roller. The inner surface of the cylindrical sleeve may define a hollow core of the cylindrical sleeve. The magnetic member may be placed in the hollow core of the cylindrical sleeve. The magnetic member may comprise one or more magnetic poles.

The magnetic member may have a plurality of magnetic poles arranged radially in alternating polarity. The magnetic member may be stationary in relation to the toner carrying roller. The cylindrical sleeve may be configured to rotate about the stationary magnetic member.

The first electrodes may comprise a finite number of stripe electrodes arranged at a regular interval. Each stripe electrode may extend parallel to lengthwise axis of the toner carrying roller. Each of the stripe electrodes may be connected to a common electrical potential. The second electrodes may comprise a finite number of ring electrodes arranged at a regular interval. Each ring electrode forming a ring around the outer circumferential surface of the image carrying roller such that the ring electrodes intersect with at least one stripe electrode at the toner transfer region. Each individual one of the ring electrodes may be selectable for applying electrical energy thereto to cause toner particles to be transferred from the toner carrying roller to the image carrying roller at the toner transfer region.

The cylindrical sleeve may be electrically conductive so as to provide the common electrical potential to the stripe electrodes.

BRIEF DESCRIPTION OF THE DRAWINGS

Various aspects of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
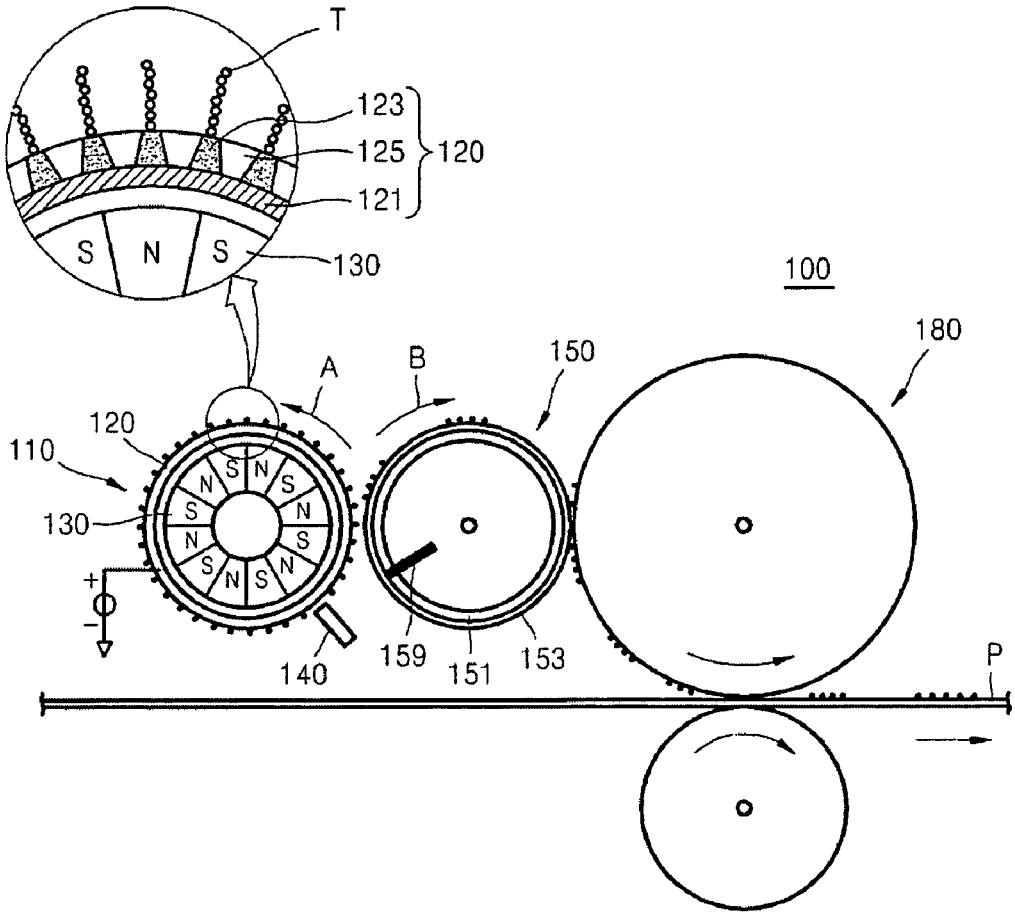
FIG. 1 is a schematic diagram of an image forming apparatus using a toner supply roller according to an embodiment.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Figure 2:
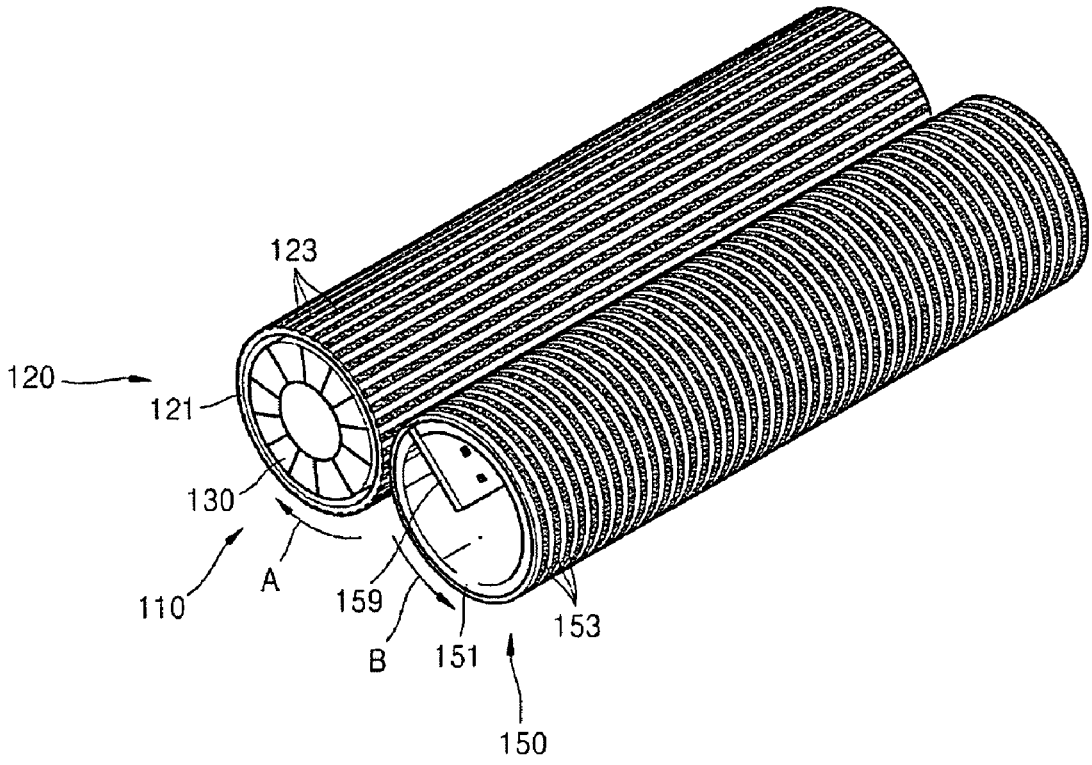
FIG. 2 is a perspective view of the toner supply roller and an image forming unit of FIG. 1.

FIG. 1 is a schematic diagram of an image forming apparatus 100 using a toner supply roller 110 according to an embodiment. FIG. 2 is a perspective view of the toner supply roller 110 and an image forming unit 150 shown in FIG. 1. Referring to FIG. 1, the image forming apparatus 100 according to an embodiment may include the toner supply roller 110, the image forming unit 150, and an image transfer unit 180.

The toner supply roller 110 selectively supplies toner particles T from a toner storage unit (not shown) to the image forming unit 150, and may include a sleeve 120 and a magnetic force creating unit 130. The toner particles T used by the image forming apparatus 100 may be both magnetic and chargeable. Reference numeral 140 of FIG. 1 is a control means that controls the amount of toner particles T that adhere to the surface of the toner supply roller 110.

The sleeve 120 includes a sleeve body 121 and a plurality of stripe electrodes 123.

The sleeve body 121 is a cylindrical-shaped member having a hollow body in which the magnetic force creating unit 130 is disposed. The sleeve body 121 may be formed of a non-magnetic material so that magnetic field lines emitted from the magnetic force creating unit 130 may exhibit lossless propagation to the outside of the sleeve 120.

The sleeve body 121 may be formed of a non-magnetic conductive metal, such as, e.g., aluminum, non-magnetic stainless steel, or the like. When conductive material is used for the sleeve body 121, the stripe electrodes 123 may be formed to directly contact the sleeve body 121 so as to be electrically connected to each other via the sleeve body 121, and to thus function as common electrodes. The sleeve body 121 may be electrically connected to an external power source (not shown).

Referring to FIG. 2, the stripe electrodes 123 are arranged on an outer surface of the sleeve body 121 as stripes that extend along the axial direction of the sleeve body 121. According to an embodiment, the stripe electrodes 123 may be formed of a material that is both magnetic and chargeable. For example, the stripe electrodes 123 may be formed of a material, such as, e.g., Ni, Fe, or the like. In this manner, when the material of the stripe electrodes 123 is magnetic, the stripe electrodes 123 may function as magnetic poles due to a magnetic force created in the magnetic force creating unit 130 disposed inside the sleeve 120.

The stripe electrodes 123 may be commonly applied a power such as a voltage or a current so that the stripe electrodes 123 may function as common electrodes. For example, the stripe electrodes 123 may be formed to directly contact the sleeve body 121, and may be commonly applied a power that is applied to the sleeve body 121. In this manner, when the power is applied to the stripe electrodes 123, the toner particles T may become charged by the applied power while being carried on the surface of the sleeve 120 due to the magnetic force from the magnetic force creating unit 130 that is to be described later.

The stripe electrodes 123 may be directly formed on the sleeve body 121 by using various methods, such as, e.g., patterning, conductive pattern printing, plating, sputtering, or the like. Widths and pitches of such stripe electrodes 123, as well as those of a plurality of ring electrodes 153 of the image forming unit 150, determine the minimum pixel size of the image that can be formed. In that regard, the resolution of image may be enhanced by controlling the widths and pitches of the stripe electrodes 123 and the ring electrodes 153 to be small. The widths and pitches of the stripe electrodes 123 may also vary according to the size of the printing medium on which the image is to be formed. In the embodiment shown in FIG. 2, the ring electrodes 153 are equi-angularly arrayed; however, other embodiments where some or all of the ring electrodes 153 may be irregularly arrayed is also possible.

The stripe electrodes 123 are also shown to be equi-angularly arrayed along the outer surface of the sleeve body 121; however, the stripe electrodes 123 may also be irregularly arrayed in some portions or an entire portion of the outer surface of the sleeve body 121.

Referring back to FIG. 1, an insulator 125 may be interposed between the stripe electrodes 123. The insulator 125 provided between the stripe electrodes 123 may prevent the toner particles T attaching to, and thus forming a magnetic brush from, the side surfaces of the stripe electrodes 123 or between each of the stripe electrodes 123, thus preventing the width of the magnetic brush from being substantially greater than the width of each of the stripe electrodes 123.

The magnetic force creating unit 130 is disposed in the hollow inner portion of the sleeve 120. The magnetic force creating unit 130 may be a magnetic roller having a plurality of magnetic poles. The magnetic poles of the magnetic force creating unit 130 may face an inner surface of the sleeve body 121 and may be arranged as alternating poles. The magnetic force creating unit 130 magnetically attract the toner particles T so that the toner particles T on the stripe electrodes 123 may be attracted to the sleeve 120 to form a magnetic brush. In the embodiment of FIG. 1, the magnetic force creating unit 130 may be fixed while the sleeve 120 rotates around the fixed magnetic force creating unit 130; however, in other embodiments, the magnetic force creating unit 130 may alternatively be arranged to rotate together with the sleeve 120.

The image forming unit 150 may include a drum body 151, the ring electrodes 153 formed on an outer surface of the drum body 151, and a connecting member 159. An insulating film (refer to reference numeral 152 of FIG. 3) may be formed between the drum body 151 and the ring electrodes 153. An insulating layer (refer to reference numeral 158 of FIG. 3) may be arranged in an outer area of the ring electrodes 153. An image forming unit 150 of above-described configuration may be rotatably mounted, and may be disposed to face and oppose the toner supply roller 110.

The drum body 151 may be a cylindrically shaped member having a hollow body. The drum body 151 may be formed of a metal such as, e.g., aluminum, or may alternatively be formed as a non-metal insulator. In the inner wall of the drum body 151, a slot of certain width may be formed to extend along the length of drum body 151 to accommodate a connecting member 159 that may be supported in the slot.

The ring electrodes 153, which are ring-shaped electrodes formed on the outer surface of the drum body 151, may be equi-angularly formed along the longitudinal direction of the drum body 151. When power is applied to the ring electrodes 153, the ring electrodes 153 generate electrostatic attraction with respect to the toner particles T. Since the power is independently applied to the ring electrodes 153, it is possible to selectively attract the toner particles T to the image forming unit 150 so as to selectively transfer the toner particles T from the toner supply roller 110.

As illustrated in FIG. 2, the ring electrodes 153 are formed and disposed to cross the stripe electrodes 123. Widths and pitches of the ring electrodes 153, as well as those of the stripe electrodes 123, determine the minimum pixel size of the image. The resolution of image may be enhanced by making the widths and pitches of the ring electrodes 153 and the stripe electrodes 123 smaller. While the ring electrodes 153 are shown in FIG. 2 as being arranged as an equi-angularly array on the outer surface of the drum body 151, the ring electrodes 153 may alternatively be irregularly arrayed along some or entire portion of the outer surface of the drum body 151 according to other embodiments.

A longitudinal end of the connecting member 159 may include a plurality of connecting electrodes, which respectively correspond to the ring electrodes 153. The plurality of connecting electrodes of the longitudinal edge of the connecting member 159 are electrically connected to the ring electrodes 153, respectively. The other longitudinal end of the connecting member 159 may be positioned towards the radial center of the drum body 151 so as to allow it to be connected to a control substrate (not shown) inside the drum body 151.

The image transfer unit 180 functions to transfer a developed image formed on the image forming unit 150 to a printing medium P.

In the above-described embodiments, the image forming apparatus 100 is shown to include only one toner supply roller 110 and only one image forming unit 150, however, according to other embodiments, a plurality of toner supply rollers 110 and image forming units 150 may be employed to, for example, form a color image. That is, a plurality of image drums corresponding to yellow (Y), magenta (M), cyan (Cy, and black (Bk) may be disposed around an outer surface of the image transfer unit 180. Also, in the embodiment shown in FIG. 1, the image transfer unit 180 is formed as a roller type; however, another type of image transfer unit 180, for example, a belt type, may also be employed according to alternative embodiments.

In case of forming the monochrome image, it may not be necessary to provide a separate image transfer unit 180 as shown in FIG. 1, instead, the printing medium P may pass between the image forming unit 150 and the image transfer unit 180 (or any other component that provides a support for the printing medium), in which case the image may be directly transferred from the image forming unit 150 to the printing medium P.

Figure 3:
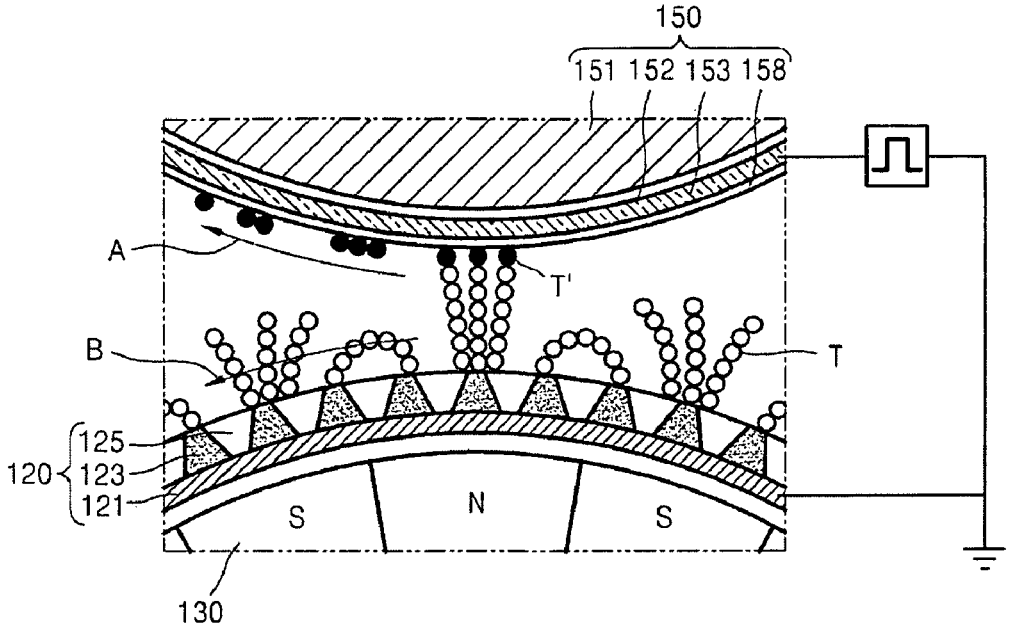
FIGS. 3 and 4 are diagrams explaining the principles of operation of the image forming apparatus of FIG. 1
Figure 4:
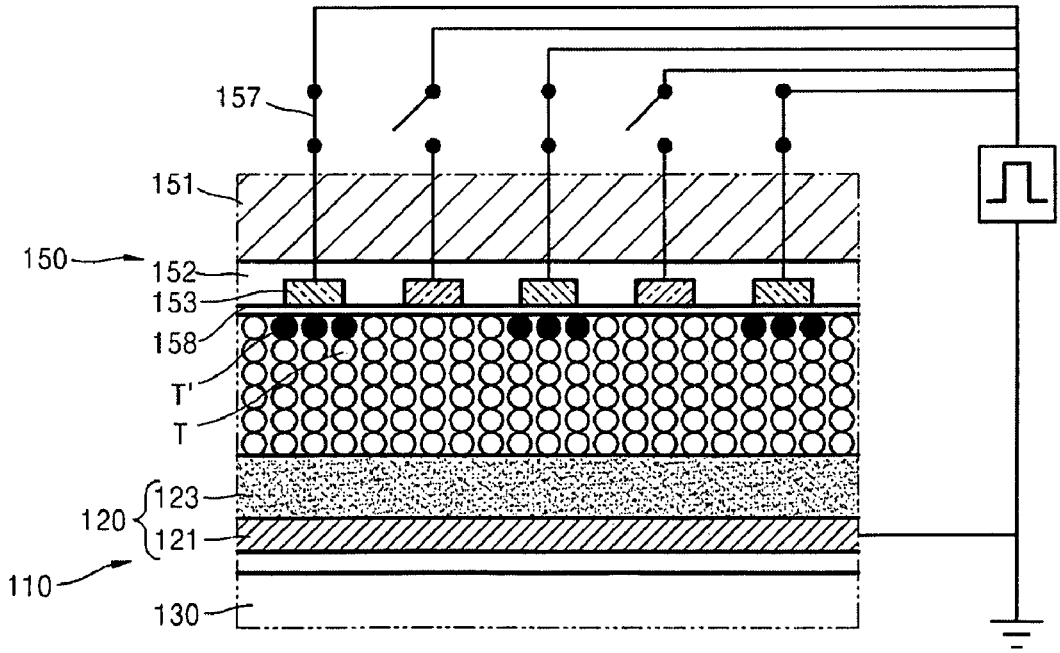

Referring now to FIGS. 3 and 4, operations of the image forming apparatus 100 according to the embodiment of FIG. 1 will be described.

FIG. 3 is a cross-sectional view taken perpendicular to the axial directions of the toner supply roller 110 and the image forming unit 150 of the image forming apparatus 100 shown in FIG. 1. FIG. 4 is a cross-sectional view taken parallel to the axial directions of the toner supply roller 110 and the image forming unit 150.

Referring to FIG. 3, the sleeve 120 rotates in a counter-clockwise direction B while the image forming unit 150 rotates in a clockwise direction A. It should be apparent that the rotational directions can be reversed. Toner particles T, which had been adhering to the sleeve 120 in the form of a magnetic brush due to the magnetic attraction provided by the magnetic force creating unit 130, may be selectively transferred to the image forming unit 150. That is, the toner particles T may be charged by the power applied to the stripe electrodes 123, and may thus be adhered to the sleeve 120 surface at each of the stripe electrodes 123. While the charged toner particles T are electrically connected to the stripe electrodes 123, there may be an electrical potential difference that exist between the charged toner particles T and the ring electrodes 153. Because the insulating layer 158 is arranged between the charged toner particles T and the ring electrodes 153, the charged toner particles T may be attracted to those ring electrodes 153 to which power is applied due to electrostatic attraction.

The toner particles T may have acting thereupon both a magnetic attraction originating from the magnetic force creating unit 130 and an electric attraction originating from the power applied to the ring electrodes 153, the relative strength of the two attractive forces deciding whether the toner particles T' will move to the image forming unit 150. The transfer of the toner particles T from the stripe electrodes 123 to the ring electrodes 153 occurs, during the rotations of the sleeve 120 and the image forming unit 150, between those locations where the ring electrodes 153 and one or more stripe electrodes 123 come into sufficient proximity with respect to each other to have the electrostatic attraction from the ring electrodes 153 act on the toner particles adhering on the one or more stripe electrodes 123. Thus, each of those locations of close proximity pairing between portions of one or more ring electrodes 153 and portions of one or more stripe electrode 123 may be thought as being a pixel of the image. Thus, the pixel size of the developed image formed on the image forming unit 150 may be selected by adjusting the pitches and/or the widths of the stripe electrodes 123 and/or the ring electrodes 153. Accordingly, in the image forming apparatus 100, the movement of the toner may be controlled with improved image resolution. The image resolution may be enhanced by making the pitches and/or widths of the stripe electrodes 123 and/or the ring electrodes 153 smaller.

Referring to FIG. 4, since power may be independently applied to each ring electrodes 153, the strength of the electrostatic attraction affecting toner particles T may be selectively controlled on individual ring electrode 153 basis. For example, by applying the voltage on select ones of the ring electrodes 153, the toner particles T' may be transferred from the sleeve 120 to the selected ones of the ring electrodes 153 as the strength of the electrostatic attraction of those ring electrode 153 is sufficiently large to overcome the magnetic attraction of the stripe electrodes 123. On the other hand, at those ring electrodes 153 to which the voltage is not applied, the toner particles T may remain adhered to the stripe electrodes 123 as a magnetic brush since the magnetic attraction of the stripe electrodes 123 is not overcome. Referring to FIG. 4, for the sake of convenience in gaining understanding, switches are illustrated for selective application of the power, it should be noted that the power may also be selectively applied to each of the ring electrodes 153 by other mechanisms or process, such as, e.g., by selective adjustment of the strength and/or the pulse width of the voltage.

Referring back to FIG. 1, the image forming apparatus 100 selectively supplies toner particles T from the toner supply roller 110 to the image forming unit 150, and thus allows a simpler construction by obviating the need for additional components that may be found in legacy image forming apparatus, such as, e.g., a magnet knife, which is used to selectively collect toner from the image forming unit, although depending on particular applications, it can still be used in some instances.

The developed image formed on the image forming unit 150 is transferred to the image transfer unit 180, and then is transferred to the printing medium P. The printing medium P is thermally treated, and the toner particles T are fused on the printing medium P forming the image on the printing medium P.

In the embodiments described above, electrodes formed at the toner supply roller 110 are used as common electrodes to which power is commonly applied, and electrodes formed at the image forming unit 150 are used as individual electrodes to which power is independently applied; however, it should be apparent that the opposite arrangement is also possible. That is, for example, electrodes formed at the toner supply roller 110 may alternatively be used as individually selectable electrodes while the electrodes formed at the image forming unit 150 may be used as common electrodes. In addition, the electrodes formed at the toner supply roller 110 may alternatively be provided as ring electrodes while the electrodes formed at the image forming unit 150 are provided as stripe electrodes.

While a toner supply roller and an image forming apparatus using the toner supply roller have been particularly shown and described with reference to several embodiments, it should be apparent to those of ordinary skill in the art that various changes in form and details may be made thereto without departing from the principles and spirit of various aspects of the present invention, the scope of which is defined in the following claims and their equivalents.

What is claimed is:

1. A toner supply roller, comprising:

a sleeve comprising a sleeve body of a cylindrical shape and a plurality of first electrodes arranged on an outer surface of the sleeve body; and a magnetic force creating unit disposed inside the sleeve body.

2. The toner supply roller of claim 1, wherein each of the plurality of first electrodes is a stripe electrode having a stripe shape that extends in an axial direction of the sleeve body.

3. The toner supply roller of claim 2, wherein the plurality of first electrodes are common electrodes that share a common electrical connection.

4. The toner supply roller of claim 3, wherein the sleeve body is formed of a non-magnetic electrically conductive metal forming the common electrical connection of the plurality of first electrodes.

5. The toner supply roller of claim 2, wherein the plurality of first electrodes are equi-angularly positioned along the outer surface of the sleeve body.

6. The toner supply roller of claim 1, wherein the plurality of first electrodes are formed of a material which is both magnetic and electrically conductive.

7. The toner supply roller of claim 1, wherein an insulator is interposed between the plurality of first electrodes.

8. The toner supply roller of claim 1, wherein the magnetic force creating unit is stationary, the sleeve being arranged to rotate around the magnetic force creating unit.

9. The toner supply roller of claim 1, wherein the magnetic force creating unit is a magnetic roller having a plurality of magnetic poles.

10. The toner supply roller of claim 9, wherein the plurality of magnetic poles of the magnetic force creating unit are arranged in such a manner that opposite magnetic poles are arranged alternately to face an inner surface of the sleeve.

11. The toner supply roller of claim 1, wherein the sleeve body is formed of a non-magnetic material.

12. An image forming apparatus comprising:

a toner supply roller which comprises a sleeve comprising a sleeve body of a cylindrical shape and a plurality of first electrodes arranged on an outer surface of the sleeve body, and a magnetic force creating unit disposed inside the sleeve body; and an image forming unit disposed to face the toner supply roller, the image forming unit being rotatably driven, and comprising a plurality of second electrodes.

13. The image forming apparatus of claim 12, wherein the plurality of first electrodes and the plurality of second electrodes cross each other, at least one of the plurality of first electrodes and the plurality of second electrodes are individually controlled to selectively move toner from the toner supply roller to the image forming unit.

14. The image forming apparatus of claim 13, wherein each of the plurality of first electrodes is a stripe electrode having a stripe shape that extends in an axial direction of the sleeve body; and each of the plurality of second electrodes is a ring-shaped electrode formed around the image forming unit.

15. The image forming apparatus of claim 14, wherein the plurality of first electrodes are common electrodes to which a common electrical power is applied, the plurality of second electrodes being configured to receive electrical power individually.

16. The image forming apparatus of claim 15, wherein the sleeve body is formed of a non-magnetic electrically conductive metal to provide a common electrical connection to the plurality of first electrodes.

17. The image forming apparatus of claim 12, wherein the plurality of first electrodes are formed of a material which is both magnetic and electrically conductive.

18. The image forming apparatus of claim 12, wherein the magnetic force creating unit is stationary, the sleeve being arranged to rotate around the magnetic force creating unit.

19. The image forming apparatus of claim 12, wherein the magnetic force creating unit is a magnetic roller having a plurality of magnetic poles.

20. A toner image forming device, comprising:

a toner carrying roller of cylindrical shape, the toner carrying roller having disposed on outer circumferential surface thereof first electrodes; and an image carrying roller of cylindrical shape having disposed on outer circumferential surface thereof second electrodes, the image carrying roller being arranged substantially parallel to the toner carrying roller such that respective outer surfaces of the toner carrying roller and the image carrying roller opposingly facing each other in a toner transfer region, intersections of the first electrodes and second electrodes at the toner transfer region defining a plurality of individually selectable toner transfer paths from the toner carrying roller to the image carrying roller.

21. The toner image forming device of claim 20, wherein:

the first electrodes comprise a finite number of stripe electrodes arranged at a regular interval, each stripe electrode extends parallel to lengthwise axis of the toner carrying roller, and wherein the second electrodes comprise a finite number of ring electrodes arranged at a regular interval, each forming a ring around the outer circumferential surface of the image carrying roller such that the ring electrodes intersect with at least one stripe electrode at the toner transfer region, each individual one of the ring electrodes being selectable for applying electrical energy thereto to cause toner particles to be transferred from the toner carrying roller to the image carrying roller at the toner transfer region.

22. The toner image forming device of claim 21, wherein:

each of the stripe electrodes is connected to a common electrical potential.

23. The toner image forming device of claim 20, wherein the toner carrying roller comprises:

a cylindrical sleeve outer surface thereof defining the outer circumferential surface of the toner carrying roller, inner surface of the cylindrical sleeve defining a hollow core of the cylindrical sleeve;

a magnetic member placed in the hollow core of the cylindrical sleeve, the magnetic member having one or more magnetic poles.

24. The toner image forming device of claim 23, wherein:

the magnetic member having a plurality of magnetic poles arranged radially in alternating polarity, the magnetic member being stationary in relation to the toner carrying roller, and wherein the cylindrical sleeve is configured to rotate about the stationary magnetic member.

25. The toner image forming device of claim 24, wherein:

the first electrodes comprise a finite number of stripe electrodes arranged at a regular interval, each stripe electrode extends parallel to lengthwise axis of the toner carrying roller, each of the stripe electrodes being connected to a common electrical potential and wherein the second electrodes comprise a finite number of ring electrodes arranged at a regular interval, each forming a ring around the outer circumferential surface of the image carrying roller such that the ring electrodes intersect with at least one stripe electrode at the toner transfer region, each individual one of the ring electrodes being selectable for applying electrical energy thereto to cause toner particles to be transferred from the toner carrying roller to the image carrying roller at the toner transfer region.

26. The toner image forming device of claim 25, wherein the cylindrical sleeve being electrically conductive so as to provide the common electrical potential to the stripe electrodes.

* * * * *